US007621463B2

(12) United States Patent
Presz, Jr. et al.

(10) Patent No.: US 7,621,463 B2
(45) Date of Patent: Nov. 24, 2009

(54) FLUID NOZZLE SYSTEM USING SELF-PROPELLING TOROIDAL VORTICES FOR LONG-RANGE JET IMPACT

(75) Inventors: Walter M. Presz, Jr., Wilbraham, MA (US); Stanley Kowalski, III, Wilbraham, MA (US)

(73) Assignee: FloDesign, Inc., Wilbraham, MA (US)

( * ) Notice: Subject to any disclaimer, the term of this patent is extended or adjusted under 35 U.S.C. 154(b) by 242 days.

(21) Appl. No.: 11/330,695

(22) Filed: Jan. 11, 2006

(65) Prior Publication Data

US 2006/0151633 A1 Jul. 13, 2006

Related U.S. Application Data

(60) Provisional application No. 60/643,443, filed on Jan. 12, 2005.

(51) Int. Cl.
*B05B 1/08* (2006.01)
*B05B 1/34* (2006.01)

(52) U.S. Cl. ..... 239/101; 239/487; 239/490

(58) Field of Classification Search ..... 239/101, 239/102.1, 589.1, 461, 463, 468, 475, 482, 239/399, 403, 417.5, 405, 406, 487, 490
See application file for complete search history.

(56) References Cited

U.S. PATENT DOCUMENTS 3,940,060 A 2/1976 Viets (Continued)

*Primary Examiner*—Davis Hwu
(74) *Attorney, Agent, or Firm*—Holland & Bonzagni, P.C.; Donald S. Holland, Esq.

(57) ABSTRACT

A fluid nozzle system (nicknamed the "RAP nozzle system") is disclosed that combines a pulse flow device with a toroidal vortex generator to create a high momentum, self propelling jet for increasing long-range jet impact forces. In a preferred embodiment, the RAP nozzle system comprises a fluid switch, without any moving mechanical part, which takes continuous flow normally exited through a nozzle and breaks it into discrete patterns of pulsed flow. The unsteady characteristics of the pulsed flow are then used with either single-stage ejectors, multi-stage ejectors or other devices to increase the momentum and/or the lateral size of the individual pulses. These fluid pulses are then used to generate a jet with large scale, stable toroidal vortices which travel long distances, downstream of the ejector(s), and apply large forces at impact. Unlike the prior art, such toroidal vortices are stable, carry large flow momentum, and propel themselves through the air (or other fluid) at a speed approximately ¼ the pulsed velocity of the fluid used to generate the vortices. Furthermore, the toroidal vortices travel beyond the RAP nozzle system with minimal mixing and minimal losses. Tests conducted have demonstrated that these toroidal vortices travel up to 10 times the distance of current continuous flow jets and can deliver an order of magnitude larger force to move particles at large distances from the nozzle exit when compared to the same energy, continuous jet. The same toroidal vortices generate stirring mechanisms at impact which can be useful in many applications. The RAP nozzle system can significantly improve the performance of leaf blowers, shop air nozzles, and all other products that utilize jet impact forces for particle movement. The same RAP nozzle system concept can be used in a significant number of other applications where fluid pulsations could be beneficial. Fluid pulsations increase the force of a fluid jet by adding impulsive forces similar to a jack hammer. These unsteady forces can be quite large and are directly related to the velocity of the jet at impact. In an alternate embodiment, the RAP nozzle concept can also carry a secondary fluid over a large distance without mixing the secondary fluid with the ambient fluid. The secondary fluid is carried in the core of the toroidal vortices generated.

4 Claims, 7 Drawing Sheets

U.S. PATENT DOCUMENTS

| | | | | |
|---|---|---|---|---|
| 4,241,877 | A | | 12/1980 | Hughes |
| 4,709,622 | A | | 12/1987 | Stouffer et al. |
| 4,955,547 | A | | 9/1990 | Woods |
| 5,052,813 | A | | 10/1991 | Latto |
| 5,100,242 | A | | 3/1992 | Latto |
| 5,190,099 | A | | 3/1993 | Mon |
| 5,213,270 | A | | 5/1993 | Stouffer et al. |
| 5,409,169 | A | * | 4/1995 | Saikalis et al. ..... 239/404 |
| 5,636,795 | A | | 6/1997 | Sedgwick |
| 5,639,022 | A | | 6/1997 | Yanta et al. |
| 6,098,904 | A | | 8/2000 | Davidson et al. |
| 6,719,830 | B2 | | 4/2004 | Illingworth et al. |
| 6,729,564 | B2 | | 5/2004 | Srinath et al. |
| 6,805,164 | B2 | | 10/2004 | Stouffer |
| 6,860,157 | B1 | | 3/2005 | Yang et al. |
| 6,938,835 | B1 | | 9/2005 | Stouffer |
| 2002/0148069 | A1 | | 10/2002 | Illingworth |
| 2003/0029476 | A1 | | 2/2003 | Lucey, Jr. et al. |
| 2003/0209006 | A1 | | 11/2003 | Gharib et al. |
| 2004/0217490 | A1 | | 11/2004 | Whiteis |
| 2005/0269458 | A1 | | 12/2005 | Harman |

* cited by examiner

FLUID NOZZLE SYSTEM USING SELF-PROPELLING TOROIDAL VORTICES FOR LONG-RANGE JET IMPACT

RELATED APPLICATION

This application claims priority from U.S. Provisional Patent Application Ser. No. 60/643,443, filed Jan. 12, 2005. Applicants hereby incorporate the disclosure of that application by reference.

BACKGROUND OF INVENTION

A fluid nozzle is a device used to accelerate and exhaust a fluid as a jet. The nozzle is usually a converging area duct which forces the fluid passing through the duct to increase in velocity and decrease in pressure. The nozzle creates a thrust force on the device the flow is exiting from; for example, a nozzle on a jet engine is used to generate thrust for the engine. The fluid exhaust jet produced by the same nozzle generates an impact force on any object it strikes. Fluid nozzles are used on compressed air shop guns to generate a high velocity jet to move shop debris. Similarly, nozzles on leaf blowers use the exiting jet to move leaves. Numerous other devices use a nozzle to generate a high momentum, fluid jet to transmit a force to an object that is a distance away from the nozzle exit.

If a jet of fluid is directed through a nozzle and into a reservoir of external still (ambient) fluid, the jet path is straight and the streamlines become parallel. This must be true because any turning, divergence, or velocity change of the jet would require a corresponding static pressure change which cannot exist in the still fluid. The friction between the moving jet and the ambient fluid causes the outer edges of the jet to be slowed down and the external fluid to be speeded up, or entrained. Thus, the jet rapidly mixes out and the jet velocity decreases with distance as presented in FIG. 1, labeled "Prior Art." Speed and the Reynolds number have only slight effects until the fluid exit velocity of the nozzle approaches the speed of sound in the fluid. The edge mixing effects penetrate to the center of the jet within an axial distance of about 5 diameters downstream of the nozzle exit, and the jet peak velocity drops over 80% within 40 diameters. For a three-inch leaf blower nozzle, this results in at least an 80% decrease in jet impingement force available (when compared to the jet momentum at the nozzle exit) to move leaves a distance of 10 feet from the nozzle being held by the user of the leaf blower.

It is a primary object of the current invention to present a fluid nozzle system that combines a controlled flow pulse device with a toroidal exhaust generation device to create a self-propelling jet for a long-range impact, e.g., for particle movement.

It is another primary object to present a fluid nozzle system that combines a controlled flow pulse device with a toroidal exhaust generation device to create a jet that travels up to 10 times the distance of current continuous flow jets.

It is a more specific object, commensurate with the above-listed objects, to combine a controlled flow pulse device with a toroidal exhaust generation device that uses single or multi-stage ejectors to increase the momentum of the unsteady pulse flow before converting the pulse into a jet with higher impact forces and/or carrying capabilities than conventional, continuous flow jets.

SUMMARY OF INVENTION

A fluid nozzle system (nicknamed the "RAP nozzle system") is disclosed that combines a controlled flow pulse device (hereinafter referred to as the "CFP" device) with a toroidal exhaust generation device (hereafter referred to as the "TEG" device), a.k.a. toroidal vortex generators. The two devices combine to create a high momentum, self propelling jet for increased long-range jet impact forces.

The RAP nozzle system takes continuous flow normally exited through a nozzle and breaks it into discrete patterns of pulsed flow. The unsteady characteristics of the pulsed flow are then used with either single-stage ejectors, multi-stage ejectors or other devices to increase the momentum and/or the lateral size of the individual pulses. These fluid pulses are then used to generate a jet with large scale, stable toroidal vortices which travel long distances and apply large forces at impact. Unlike the prior art, toroidal vortices created by the RAP nozzle system are relatively stable; they carry large flow momentum; and they propel themselves through the air (or other fluid) at a speed approximately ¼ the pulsed velocity of the fluid used to generate the vortices. Tests conducted have demonstrated that these toroidal vortices travel up to 10 times the distance of continuous jets and can deliver an order of magnitude larger force to move particles at large distances from the nozzle exit when compared to the same energy, continuous jet. The same toroidal vortices generate stirring mechanisms at impact which can be useful in many applications.

In the first preferred embodiment, the RAP nozzle system comprises: a fluidic switch or oscillator as a controlled flow pulse device (i.e., "CFP" device) which provides Repetitive Alternating Pulses (source of "RAP" acronym) in two exhaust ducts, and single or multi-stage ejectors with large lip orifice nozzles as toroidal exhaust generation devices (i.e., "TEG" devices) in one or both of the exhaust ducts to amplify and convert the pulse flow into discrete toroidal exhaust vortices.

Alternate RAP nozzle CFP devices are disclosed. These preferred CFP devices convert a steady flow of fluid into controlled fluid pulses. Each pulse has a volume of fluid that is the same order of magnitude as the volume of fluid required by the toroidal vortex that is generated in the coupled TEG device.

In a second preferred embodiment, the RAP nozzle system comprises: a CFP device that uses a control valve to convert continuous, steady fluid flow with a given flow rate into controlled flow pulses in a single exhaust duct; and a TEG device which amplifies and uses the discrete fluid pulses provided by the CFP device to generate toroidal vortices and thus increase the impact force, stirring capability, or carrying capability of the exiting jet over jets produced by conventional fluid flow nozzles.

The TEG device comprises single or multi-stage ejectors and/or diffuser ducting combined with a large lip orifice (discharge) nozzle to amplify and convert fluid pulses into higher momentum, toroidal vortices. Such toroidal vortices propel themselves through the fluid at roughly ¼ the maximum ideal speed of a continuous jet, but carry much higher velocities and impact force capabilities than continuous jets. The same vortices minimize jet mixing and energy loss as the jet flow propels itself through the fluid. Single or multi-stage ejectors dramatically increase the momentum of the fluid pulses in the TEG device before they are converted into toroidal vortices. The unsteady wave characteristics set up by the fluid pulses provide an efficient means to transfer energy from the fluid pulse to a secondary flow and obtain thrust augmentation, or higher flow momentum. Test results with mixer/ejector TEG devices have shown such multi-stage ejectors dramatically increase the jet impact force capability, the toroidal vortex size capability and the stability of the vortices that can be generated with TEG devices. Tests have demonstrated that larger vortices are more stable and effective for producing jet impact forces. Diffusers can also be used to increase vortex size, but their use is limited by flow separation and length constraints imposed by the shallow wall angles required for working diffusers.

Other objects and advantages of the current invention will become more readily apparent when the following written description is read in conjunction with the accompanying drawings.

DETAILED DESCRIPTION OF PREFERRED EMBODIMENTS

Figure 1:
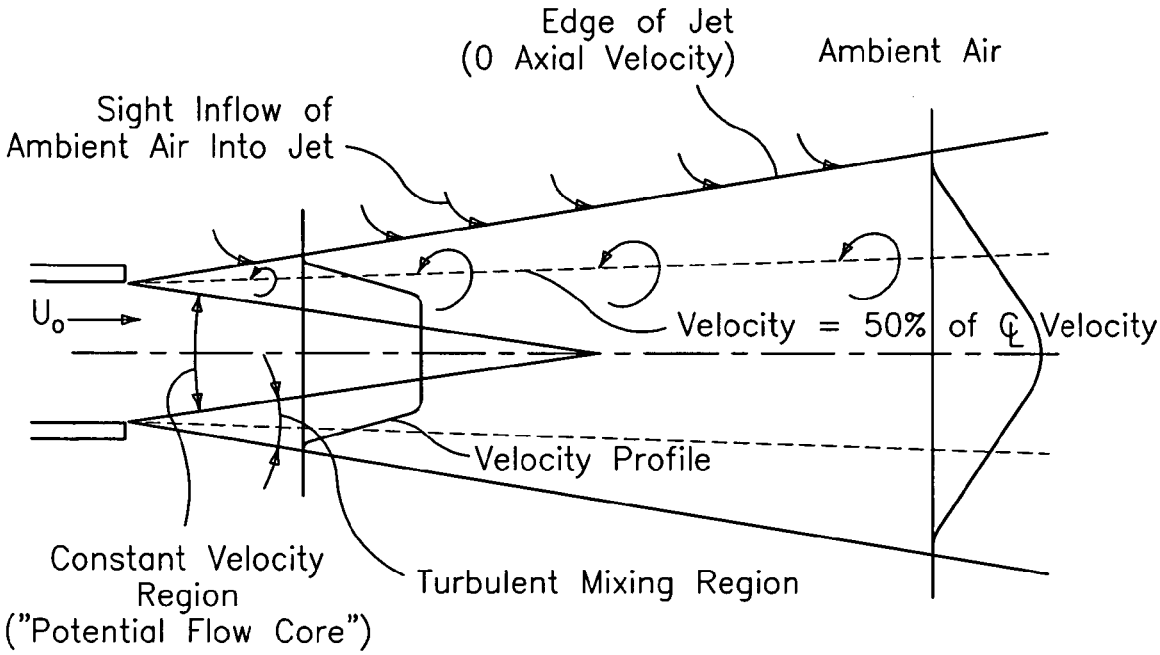
FIG. 1 (PRIOR ART)
FIG. 1, labeled "Prior Art," shows a subsonic fluid jet issuing from a standard nozzle.

Referring to the drawings in detail, Applicants' novel fluid nozzle system (nicknamed the "RAP nozzle system") is disclosed. The RAP nozzle system combines a controlled flow pulse (hereinafter "CFP") means or device with a toroidal exhaust generation (hereinafter "TEG") means or device (a.k.a. toroidal vortex generator) to create a high momentum, self propelling jet (i.e., toroidal vortices) for increasing long-range jet impact forces.

Figure 2A:
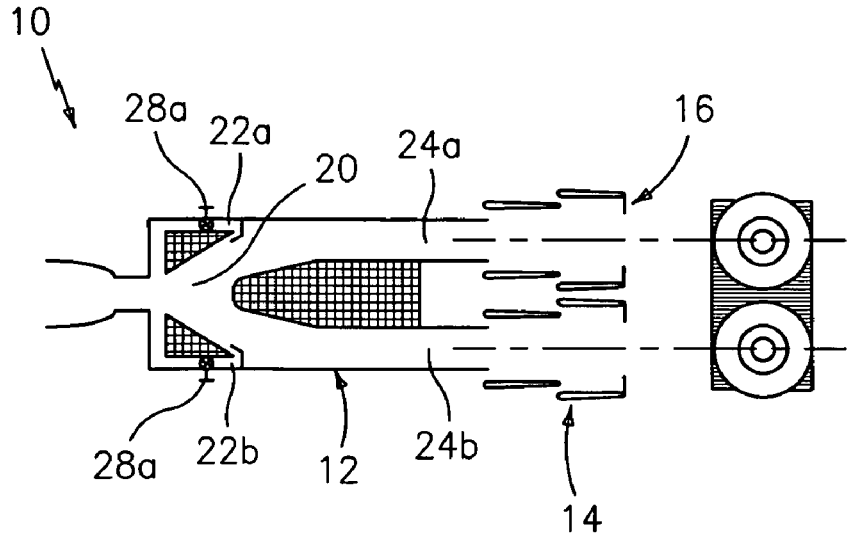
FIGS. 2A, 2B show a RAP nozzle system, constructed in accordance with the present invention, having a controlled fluid pulses device and a toroidal exhaust generator device.
Figure 2B:
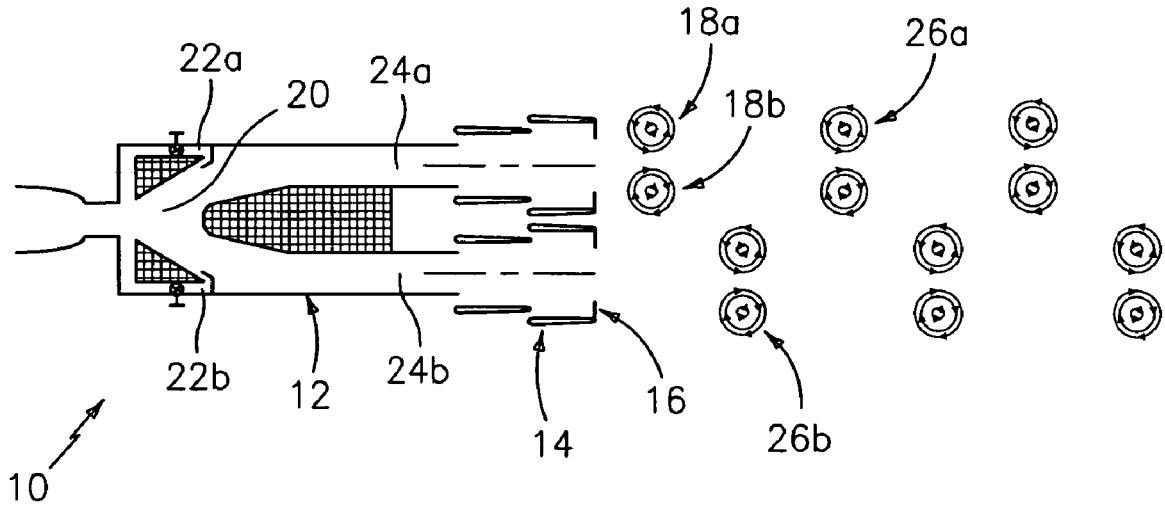

Applicants' preferred embodiment 10 of the RAP nozzle system is shown in FIGS. 2A, 2B. It comprises a fluidic switch means or oscillator 12 as the "CFP" device and multi-stage ejectors 14 (see also FIG. 7C) with large lip, orifice nozzles 16 (see also FIGS. 6A, 6B) as toroidal exhaust generation (hereinafter "TEG") devices to amplify and convert the pulse flow energy into discrete toroidal vortices, e.g., 18*a* and 18*b*. The fluidic switch 12 uses a bi-stable diffuser 20 with feedback control ports 22*a*, 22*b* to provide Repetitive Alternating Pulses (source of "RAP" acronym) between the two exit ports 24*a* and 24*b*, as demonstrated in FIG. 3A. There are no moving parts in this CFP device and the discrete fluid pulses (e.g., 26*a*, 26*b*) alternate between the two exit ports 24*a*, 24*b*.

The pulse frequency, in this preferred RAP nozzle system, is tuned to be optimum for the desired operation of the TEG device. The frequency of the fluid pulses is varied by varying the feedback ports 22*a*, 22*b* (e.g., a control mechanism could be a pair of identical mechanical valves 28*a*, 28*b* as shown in the ports). The flow of fluid is not interrupted with this fluidic CFP device; it is alternately switched between two exit ports 24*a*, 24*b*. In this fashion, the fluid pulses as demonstrated in FIG. 3A (e.g., 31*a*, 31*b*) put together would generate the original continuous flow.

Figure 3A:
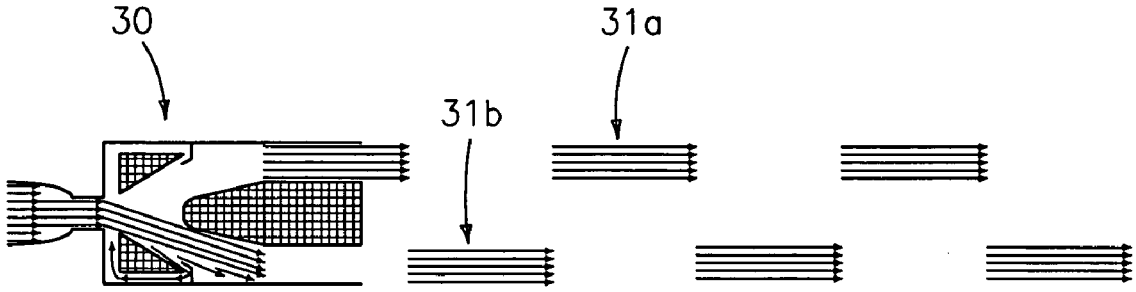
FIG. 3A shows a CFP device using a fluidic bi-stable switch with two different exhaust ducts.
Figure 3B:
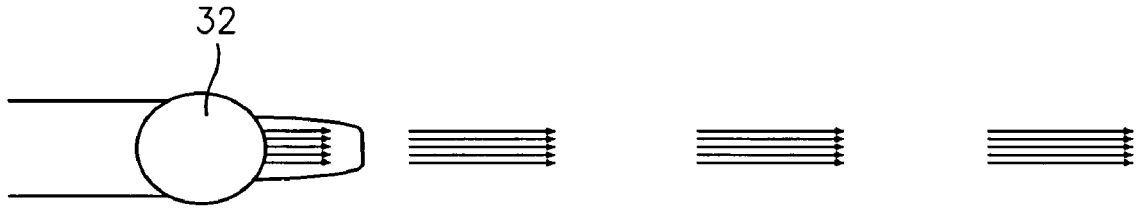
FIGS. 3B, 3C show CFP devices using controlled valves with single exhaust ducts.
Figure 3C:
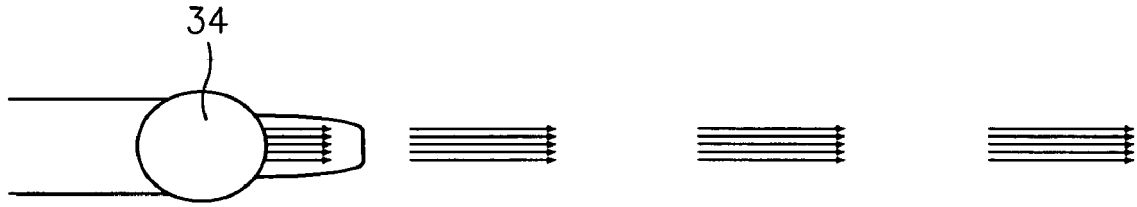

It should be understood that the CFP device 10 could use an electronic controlled fluid switch 30 (see FIG. 3A) to replace the fluidic switch 12. It could also be an electronically controlled valve 32 (see FIG. 3B), or a mechanically controlled valve 34 (see FIG. 3C), where the flow of fluid is interrupted in a controlled fashion as shown in FIGS. 3A, 3B, 3C.

Figure 4:
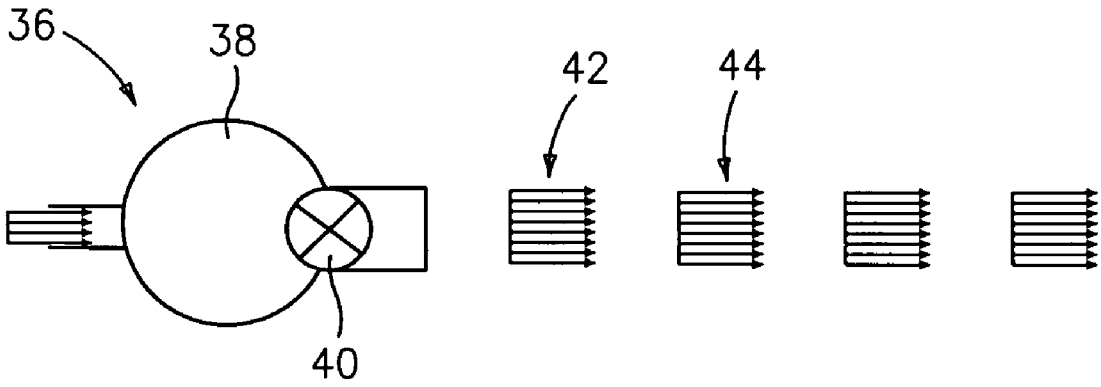
FIG. 4 shows a controlled fluid pulse device with an inline plenum.
Figure 5:
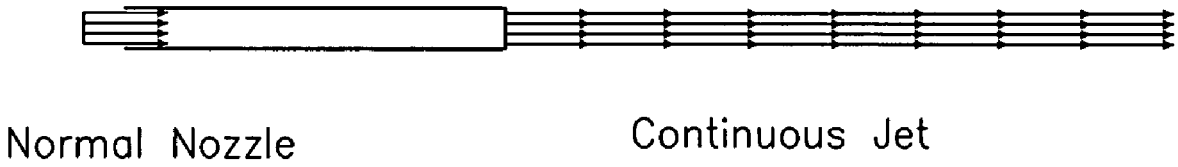
FIG. 5 (PRIOR ART)
FIG. 5, labeled "Prior Art," shows a conventional tubular nozzle with a continuous discharge.

Another variation 36 of Applicants° CFP device is shown in FIG. 4. Typically higher energy fluid can be obtained from a supply system when the flow rate is reduced. Where this occurs with gas flow, the CFP device 36 could use an inline plenum 38 followed by an electronically or mechanically controlled valve 40 as shown in FIG. 4. As the plenum pressure increases when the valve 40 is closed, the flow rate into the plenum 38 decreases. This allows the plenum to be pressurized to a higher pressure before the gas is released through an exit control valve as a fluid pulse, e.g., 42. The pressure generating the pulse can be higher than would be available at the entrance of a conventional nozzle (shown in FIG. 5) when it is continuously flowing, because of the lower losses associated with generating the pulses. The control valve 40 can then generate pulses (e.g., 42, 44) of air at higher energy and momentum than is possible with a standard continuous jet, shown in FIG. 5. The pulses of air are released through a toroidal exhaust generation ("TEG") device, described below. Such valve controlled CFP devices require moving parts. Again, the frequency of the pulses (e.g., 42, 44) is controlled for the optimum operation of the TEG device. The volume of fluid in each pulse has to be the same order of magnitude as the volume of fluid in the toroidal vortices generated.

All of the disclosed CFP embodiments or means can provide discrete and controlled pulses of fluid to a TEG device. Each CFP requires a high-pressure fluid source to work. The fluid source could be an air compressor with storage tank 46 (see FIG. 8), pump (not shown), storage tank (not shown) or pressurized container 84 (see FIG. 9).

Applicants' second preferred embodiment of the RAP nozzle system is shown as different variations in FIGS. 6A, 6B, 6C, 7A, 7B, 7C, 8. This embodiment includes a CFP device which uses a control valve to generate fluid pulses in a single exhaust duct and a "TEG" device which amplifies and uses the discrete fluid pulses provided by the CFP device to generate toroidal vortices. The self propelling toroidal vortices increase the impact force, stirring capability, or carrying capability of the exiting jet over jets produced by conventional fluid flow nozzles.

Figure 6B:
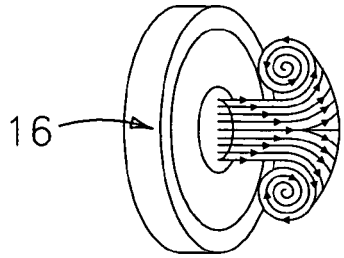
FIG. 6B is another view of the orifice lip and resultant vortices shown in FIG. 6A.
Figure 6A:
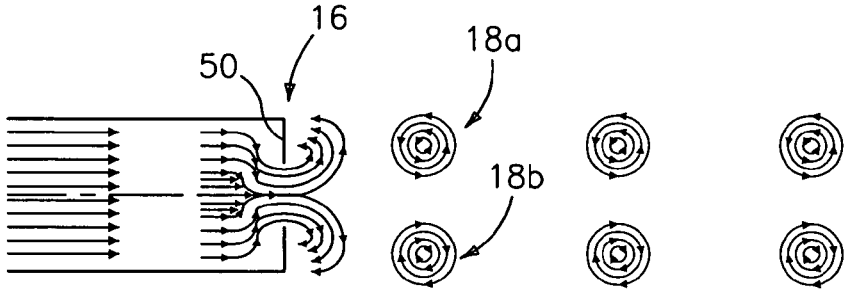
FIG. 6A shows the discharge of a toroidal exhaust generation device with a large orifice lip (discharge) nozzle and the resulting toroidal vortex formations.

Applicants' preferred embodiment of the TEG device is shown in FIGS. 6A, 6B. It includes the large lip, orifice nozzle 16 which is used in combination with a diffuser (as in FIG. 7A) to generate discrete toroidal vortices (e.g., 18*a*, 18*b*). Toroidal vortices, created off the axisymmetric lip 50, propel themselves through the fluid at roughly ¼ the maximum ideal speed of a continuous jet (see FIG. 5), but carry much higher velocities and impact force capabilities.

Referring to FIG. 6B, the pulse flow exits the orifice nozzle 16 and entrains, or drags along air near the annular lip 50. This effect causes a low pressure, or suction to be generated by the lip. The low lip pressure causes the pulse flow to turn and form a large toroidal vortex (e.g., 18*a*).

Figure 6C:
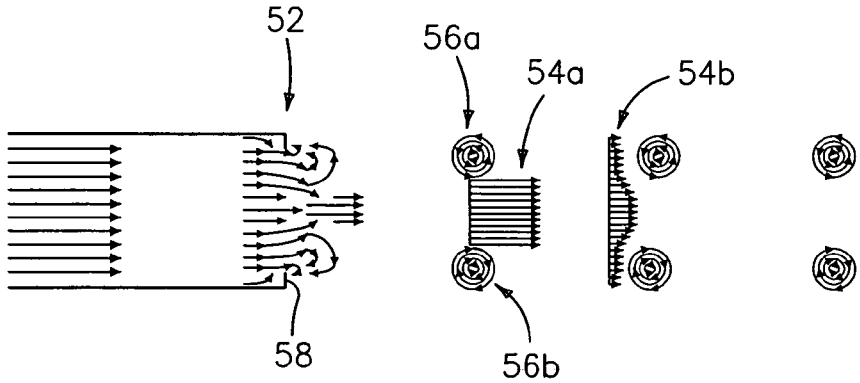
FIG. 6C shows the discharge of a toroidal exhaust generation device with an intermediate lip nozzle and the resultant toroidal vortices and jet pulses.

FIGS. 6A and 6C present two variations 16, 52 of orifice lip nozzles. The orifice nozzle can be designed to generate: only toroidal vortices (e.g., 18*a*, 18*b*) associated with the largest lip 50 in FIG. 6A; or a combination of jet pulses (e.g., 54*a*, 54*b*) and smaller toroidal vortices (e.g., 56*a*, 56*b*) associated with a smaller lip 58 in FIG. 6C. The preferred orifice lip nozzle is a flat plate with a round central hole.

Figure 6D:
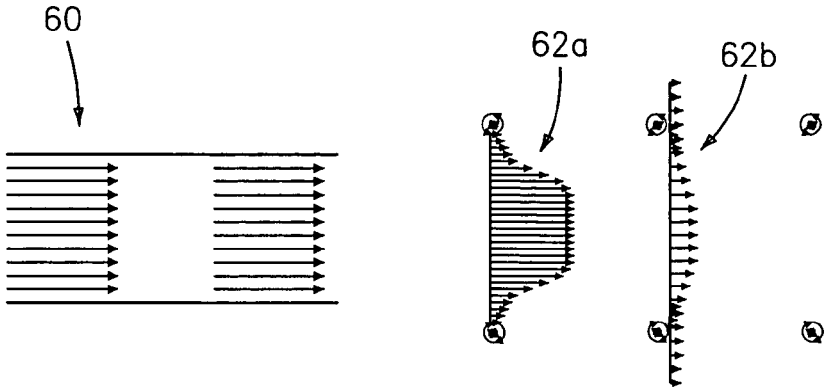
FIG. 6D shows the discharge of a toroidal exhaust generation device without a lip and the resultant jet pulses.

FIG. 6D shows a TEG system 60 without an orifice lip. Note that the discharges are predominantly jet pulses (e.g., 62*a*, 62*b*). Those jet pulses dissipate quicker than the discharges shown for the lipped TEG devices in FIGS. 6A, 6C.

The TEG device without a lip, shown in FIG. 6D, generates larger jet impact forces near the nozzle exit than with the full lip 50 (see FIG. 6A) and toroidal vortex (e.g., 18*a*). Lip 50 results in a jet momentum loss at the nozzle exit required to generate the desired vortex. The toroidal vortex (e.g., 18*a*, 18*b*) though minimizes jet impact force losses downstream of the nozzle exit. The jet force with the toroidal vortex (e.g., 18*a*, 18*b*) is an order of magnitude larger at distances of forty or more nozzle diameters than with fluid pulses.

The same RAP nozzle system without a lip on the TEG device (as in FIG. 6D) can generate much larger jet impingement forces than continuously flowing nozzles (see FIG. 5) when a liquid is injected into a gaseous medium. By utilizing this RAP nozzle invention, the resultant liquid pulses will not be mixed out rapidly by an external gas. Large impulse forces at impact are generated by a liquid pulse in a gaseous medium at further distances than conventional nozzle exits at all distances downstream of the nozzle exit. Whenever formation is possible though, self-propelled toroidal vortices increase the impact force of a pulsed jet at a distance. TEG devices can include duct sections with varying area distributions to improve toroidal vortex formation.

Lip 50 (see FIG. 6A) is approximately ½ the diameter of the nozzle exit. Lip 58 (see 6C) is approximately ¼ the diameter of the nozzle exit. Studies have shown that lips between ¼ to ½ the diameter of the nozzle exit provide the optimum results for generating effective, self-propelling vortices. Anything less than ¼ reduces the energy and impact force capability of the toroidal vortices formed, and anything greater than ½ causes significant losses associated with forming the toroidal vortices and again reduces the impact capability of such vortices.

Note that the RAP nozzle system requires that the working medium be either a gas or liquid. The RAP nozzle system can exhaust a gas into a gas, or a liquid into a liquid, while generating self-propelling toroidal vortices to increase the impact force, stirring capability, or carrying capability of the exhaust jet generated. The RAP nozzle system, as described herein, will not produce self-propelling toroidal vortices when exhausting a liquid into a gas, or a gas into a liquid.

Figure 7A:
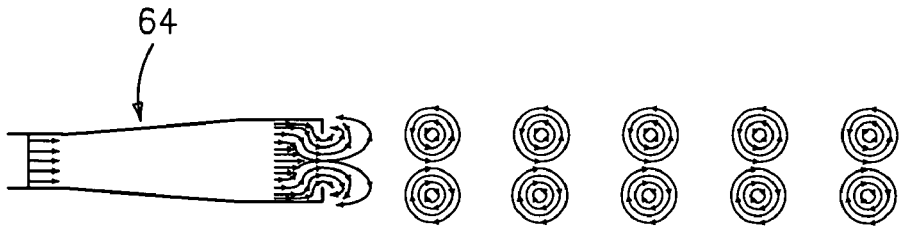
FIG. 7A shows a toroidal exhaust generation device with a diffuser and the resultant vortices.

Tests have demonstrated that larger vortices are more stable and effective. FIG. 7A presents a diffuser 64 before the required TEG orifice nozzles. A diffuser is a duct with increasing flow area. It results in the fluid velocity decreasing and the fluid pressure increasing as it flows through the duct. The increasing pressure requires very shallow wall angles; otherwise the flow separates from the duct walls and will not fill the area. This requires very long ducts for working diffusers and seriously limits their practical application in TEG devices. Multi-stage ejectors avoid this limitation, and further, they generate a dramatic increase in jet pulse momentum before the toroidal vortex is formed.

Figure 7B:
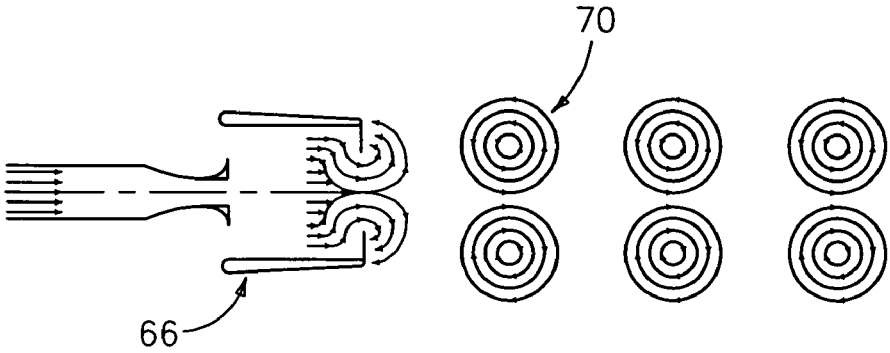
FIG. 7B shows a toroidal exhaust generation device with a single stage mixer/ejector having an orifice lip nozzle and the resultant vortices.
Figure 7C:
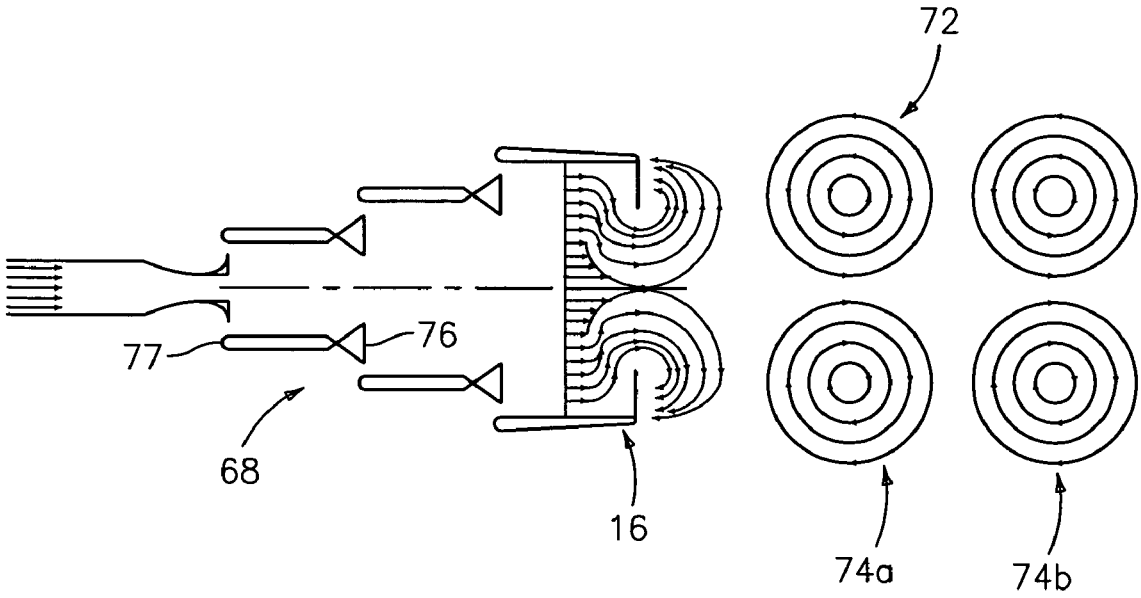
FIG. 7C shows a toroidal exhaust generation device with a multi-stage mixer/ejector having an orifice lip nozzle and the resultant vortices.

Applicants' preferred TEG device includes a multi-stage ejector (e.g., 14) before the orifice nozzle (e.g., 16) to increase vortex size and impact force. The ejectors can include lobed nozzles, slotted nozzles or other devices (e.g., 76) that enhance the energy transfer from the primary to secondary fluid resulting in an increase in ejector augmentation, or the momentum increase of the fluid pulse. Single stage mixer/ejectors 66 and multi-stage mixer/ejectors 68, as respectively shown in FIGS. 7B and 7C, dramatically increase the toroidal vortex (70, 72) size and impact force. FIGS. 7A, 7B, 7C present three different TEG devices: the diffuser 64 with an orifice nozzle 16, the single stage mixer/ejector 66 with an orifice nozzle 16, and a multi-stage mixer/ejector 68 with an orifice nozzle 16. Multi-stage ejectors can dramatically increase the force generated by pulse flow. The unsteady wave characteristics set up by the fluid pulses (e.g., 74*a*, 74*b*) provide an efficient means to transfer energy from the fluid pulse to a secondary flow and obtain thrust augmentation, or an increase in fluid pulse momentum. The multi-stage inlet contours have to be aerodynamically shaped (e.g., 77) to provide the increased surface regions required to generate larger suction forces and more energy transfer through inviscid mechanisms. Test results with mixer/ejector TEG devices have shown such ejectors dramatically increase the jet impact force capability, the toroidal vortex size capability and the stability of the vortices that can be generated with TEG devices.

Figure 8:
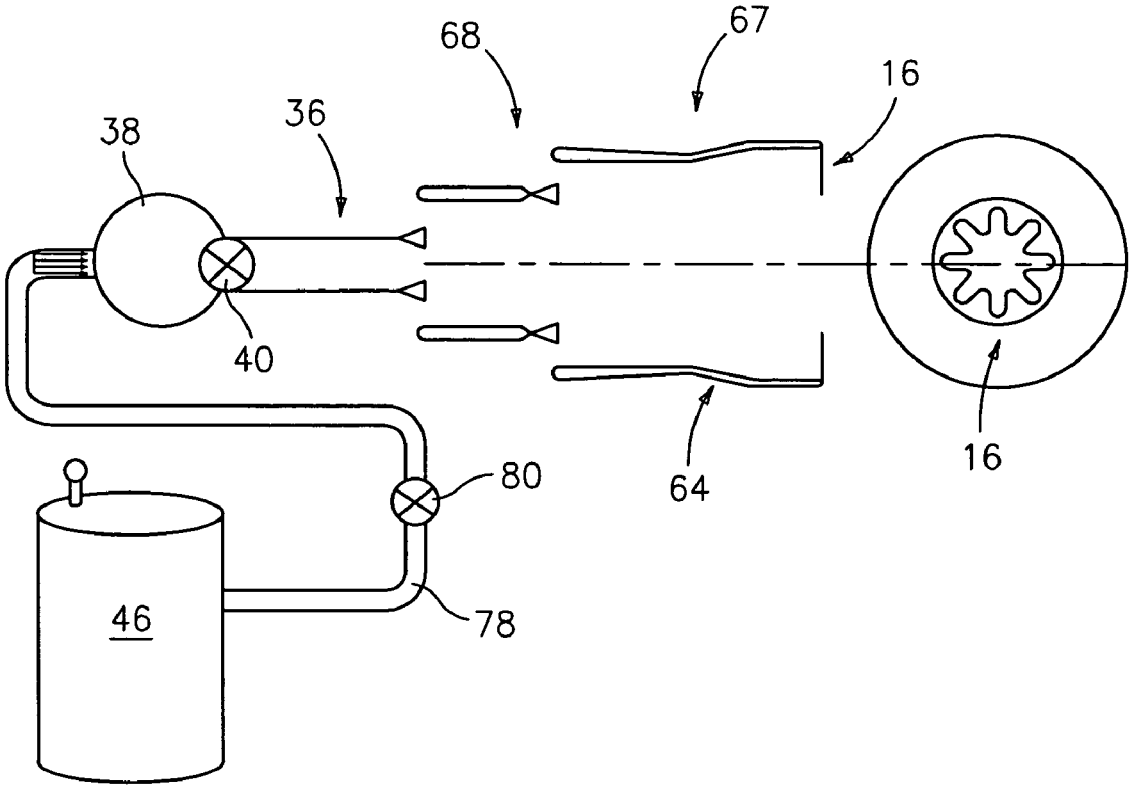
FIG. 8 shows a RAP nozzle system, constructed in accordance with the present invention, having an air source, plenum, controlled flow pulse device, and a multi-stage mixer/ejector with an orifice nozzle lip.

FIG. 8 illustrates a sample RAP nozzle system combining previously discussed components. This combination uses gases as the working fluid medium. The source of fluid energy is a high pressure storage tank 46 with a built-in air compressor and shut-off valve. It is assumed that the pressurized gas has to pass through a maze of supply lines (e.g., 78) and valves (e.g., 80) before reaching the illustrated RAP nozzle or CFP device 36 (see FIG. 4). The CFP device 36 uses an electronically or mechanically controlled valve 40 downstream of an inline plenum 38 (see FIG. 4). When the gas flow is stopped by the valve 40, flow continues to flow into the plenum 38. As the plenum pressure increases, the flow rate into the plenum decreases. This allows the plenum 38 to be pressurized to a higher pressure before the gas is released through a control valve 40 as a fluid pulse. The pressure generating the pulse (not shown) will be higher than would be available at the entrance of a conventional nozzle when it is continuously flowing, because of the lower losses associated with generating the pulse. The control valve 40 can then generate pulses of gas at higher energy and momentum than is possible with a continuous jet. The pulse of gas is released through the TEG device 67. The TEG device uses a multi-stage mixer/ejector 68 (see FIG. 7C) with a diffuser duct 64 (see FIG. 7A) before the orifice nozzle 16 to amplify the fluid pulses and to further increase vortex size. Test results with mixer/ejector/diffuser TEG devices have shown such devices dramatically increase the jet impact force capability, the toroidal vortex size capability and the stability of the vortices that are generated by RAP nozzle systems.

Figure 9:
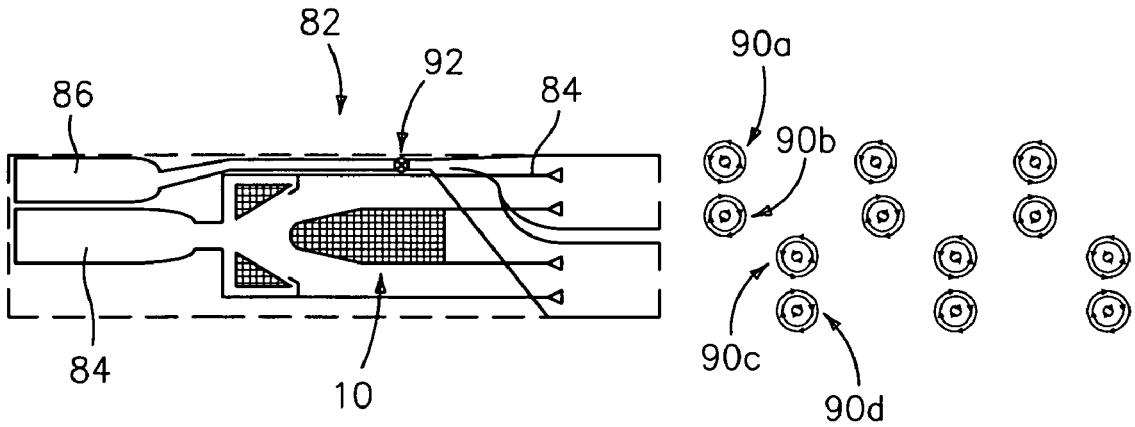
FIG. 9 shows a simpler RAP nozzle system constructed in accordance with the present invention.

FIG. 9 shows another, much simpler embodiment of Applicants' RAP nozzle system. This embodiment, while not as forceful as that shown in FIG. 8, is designed to carry a secondary fluid by a primary fluid over a specified distance. This RAP nozzle device 82 assumes gases as the working medium. The preferred source of energy is a high pressure gas storage capsule 84 shown in FIG. 9. This capsule could be a $CO_2$ cartridge. The secondary gas source 86 is a low pressure tear gas capsule or other desired medium. The RAP nozzle 82 uses a fluidic switch 10 (see FIGS. 2A, 2B) and a single-stage mixer/ejector orifice nozzle 88 as the TEG device to allow insertion of the secondary gas into the toroidal vortices (e.g., 90*a*, 90*b*, 90*c*, 90*d*) formed. The secondary gas is entrained into the core of the vortices generated by the energy associated with the high pressure primary gas pulses set up by the CFP device. The valve on the secondary gas line shown in FIG. 9 is a check valve 92 which is opened by the suction forces set up when the ejector is operating. The TEG device could be the single stage mixer/ejector orifice nozzle shown, or could include multi-stage ejectors with diffusers to increase the size of the desired vortices.

Each of the CFP devices disclosed herein, and their equivalents, is to be considered as a controlled flow pulse means for converting continuous fluid flow from a source of pressurized fluid into controlled, discrete flow pulses. Similarly, each of the disclosed TEG devices, and their equivalents, is to be considered as a toroidal exhaust generation means for generating higher, long range jet impact forces.

It should be understood by those skilled in the art that obvious structural modifications can be made to the disclosed embodiments without departing from the spirit or scope of the invention. For example, the shape of the orifice lips could be modified. Accordingly, reference should be made primarily to the appended claims rather than the foregoing description.

The invention claimed is:

1. A fluid nozzle system comprising:

a. a source of pressurized primary fluid flow;

b. an external ambient fluid;

c. a controlled flow pulse means for converting continuous fluid flow from the pressurized source into controlled, discrete flow pulses, wherein the controlled flow pulse means comprises:

i. a mechanically actuated, fluidic switch having multiple exit ducts for the discrete fluid pulses; and ii. the switch is mechanically connected in fluid communication with the source of pressurized fluid;

d. a toroidal exhaust generation means for generating toroidal vortices from the external fluid combined with the discrete flow pulses, wherein the toroidal exhaust generation means comprises a toroidal vortex generation device having an axisymmetric orifice nozzle with a lip, connected in fluid communication with the controlled flow pulse device, and wherein the toroidal vortex generation device comprises an ejector, downstream of the controlled flow pulse device and upstream of the axisymmetric orifice nozzle, to use the unsteady fluid forces to pump ambient fluid and thereby increase pulse scale and momentum and dramatically increase scale and jet impact forces of toroidal vortices generated, whereby:

i. the toroidal vortices are generated as part of the flow pulses emanating from the orifice nozzle as an exhaust jet in the ambient fluid; and ii. the toroidal vortices propel themselves downstream of the fluid nozzle system and in the ambient fluid at a speed substantially equal to ¼ the velocity of the exhaust jet exiting the orifice nozzle, and iii. the flow pulses and toroidal vortices generated by the fluid nozzle system increase an impact force and a stirring capability of the exhaust jet over that of jets produced by conventional, continuous flow nozzles; and e. wherein the controlled flow pulse device includes an inline plenum connected in fluid communication between the pressurized source and an exit control valve downstream of the plenum, whereby interruption of the flow of the primary fluid by the control valve decreases the flow rate of pressurized primary fluid into the plenum thereby allowing the plenum to be pressurized to a higher pressure before the primary fluid is released through the exit control valve as a fluid pulse.

2. A fluid nozzle system comprising:

a. a source of pressurized primary fluid flow;

b. an external ambient fluid;

c. a controlled flow pulse means for converting continuous fluid flow from the pressurized source into controlled, discrete flow pulses, wherein the controlled flow pulse means comprises:

i. a mechanically actuated, fluidic switch having multiple exit ducts for the discrete fluid pulses; and ii. the switch is mechanically connected in fluid communication with the source of pressurized fluid;

d. a toroidal exhaust generation means for generating toroidal vortices from the external fluid combined with the discrete flow pulses, wherein the toroidal exhaust generation means comprises a toroidal vortex generation device having an axisymmetric orifice nozzle with a lip, connected in fluid communication with the controlled flow pulse device, and wherein the toroidal vortex generation device comprises an ejector, downstream of the controlled flow pulse device and upstream of the axisymmetric orifice nozzle, to use the unsteady fluid forces to pump ambient fluid and thereby increase pulse scale and momentum and dramatically increase scale and jet impact forces of toroidal vortices generated, whereby:

i. the toroidal vortices are generated as part of the flow pulses emanating from the orifice nozzle as an exhaust jet in the ambient fluid; and ii. the toroidal vortices propel themselves downstream of the fluid nozzle system and in the ambient fluid at a speed substantially equal to ¼ the velocity of the exhaust jet exiting the orifice nozzle, and iii. the flow pulses and toroidal vortices generated by the fluid nozzle system increase an impact force and a stirring capability of the exhaust jet over that of jets produced by conventional, continuous flow nozzles; and e. wherein diffuser ducts are added after the ejector and before the orifice nozzle whereby the diffuser ducts increase a scale of the toroidal vortices generated by the fluid nozzle system for better stability.

3. The fluid nozzle system of claim 2 wherein lobed mixers are added to the ejector nozzle surfaces to enhance ejector pumping and increase jet thrust generation.

4. The fluid nozzle system of claim 2 wherein slots are added to the ejector nozzle surfaces to enhance ejector pumping and increase jet thrust generation.

* * * * *